US006808171B2

(12) United States Patent
Carter et al.

(10) Patent No.: US 6,808,171 B2
(45) Date of Patent: Oct. 26, 2004

(54) INVERTER HAVING A SLOW SPEED DRIVE MODE FOR IMPROVED RELIABILITY

(75) Inventors: Daniel L. Carter, Georgetown, KY (US); Joseph S. Vetromile, Rochester, NY (US); David M. Attridge, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 69 days.

(21) Appl. No.: 10/113,462

(22) Filed: Mar. 29, 2002

(65) Prior Publication Data

US 2002/0158404 A1 Oct. 31, 2002

Related U.S. Application Data

(60) Provisional application No. 60/286,896, filed on Apr. 27, 2001.

(51) Int. Cl.[7] ..... B65H 29/00
(52) U.S. Cl. ..... 271/186; 271/291
(58) Field of Search ..... 271/186, 902, 271/126, 265.01, 265.02, 270, 303

(56) References Cited

U.S. PATENT DOCUMENTS 4,346,880 A * 8/1982 Roller et al. ..... 271/186
4,359,217 A * 11/1982 Roller et al. ..... 271/186
4,673,176 A * 6/1987 Schenk ..... 271/186
5,082,272 A * 1/1992 Xydias et al. ..... 271/186
5,131,649 A * 7/1992 Martin et al. ..... 271/302
5,449,164 A * 9/1995 Quesnel et al. ..... 271/186
5,720,478 A * 2/1998 Carter et al. ..... 271/186
5,887,868 A * 3/1999 Lambert et al. ..... 271/186
6,341,777 B1 * 1/2002 Carter ..... 271/291
6,419,222 B1 * 7/2002 Morrison et al. ..... 271/186

* cited by examiner

*Primary Examiner*—Donald P. Walsh
*Assistant Examiner*—Kaitlin Joerger
(74) *Attorney, Agent, or Firm*—Lloyd F. Bean, II

(57) ABSTRACT

A substrate inverter, comprising: an inversion channel having an input path having an input nip and output path having an output nip; input drive means for driving a substrate into the inversion channel means in an initial incoming direction so that a leading edge and trailing edge of the substrate pass by the input nip until the trailing edge of substrate reaches a first position in the inversion channel; output drive means for driving the substrate out of the inversion channel in an output direction generally opposite the initial incoming direction; the output drive means includes a nip for engaging the leading edge of the substrate when the substrate is in the first position; a Controller, responsive to the output drive means, for adjusting speed of the output drive means so that substrate is driven a first speed until the trailing edge of substrate reaches a second position in the inversion channel, and second speed when the trailing edge passes the second position or stop.

3 Claims, 3 Drawing Sheets

INVERTER HAVING A SLOW SPEED DRIVE MODE FOR IMPROVED RELIABILITY

This application is based on a Provisional Patent Application No. 60/286,896, filed Apr. 27, 2001.

BACKGROUND AND SUMMARY

The present invention relates to an improved sheet inverting system, and more particularly to an inverter providing improved handling of variable sized sheets within the inverter which employs a slow speed drive mode for improved reliability.

As xerographic and other copiers/printers increase in speed, and become more automatic, it is increasingly important to provide higher speed yet more reliable and more automatic handling of both the copy sheets being made by the copier and the original document sheets being copied. It is desired to accommodate sheets which may vary widely in size, weight, thickness, material, condition, humidity, age, etc. These variations change the beam strength or flexural resistance and other characteristics of the sheets. Yet the desire for automatic and high speed handling of such sheets without jams, misfeeds, uneven feeding times, or other interruptions increases the need for reliability of all sheet handling components. A sheet inverter is one such sheet handling component with particular reliability problems.

Although, a sheet inverter is referred to in the copier art as an "inverter", its function is not necessary to immediately turn the sheet over (i.e., exchange one face for the other). Its function is to effectively reverse the sheet orientation in its direction of motion. That is, to reverse the lead edge and trail edge orientation of the sheet. Typically in inverter devices, as disclosed here, the sheet is driven or fed by feed rollers or other suitable sheet driving mechanisms into a sheet reversing chute. By reversing the motion of the sheet within the chute and feeding it back out from the chute, the desired reversal of the leading and trailing edges of the sheet in the sheet path is accomplished. Depending on the location and orientation of the inverter in a particular sheet path, this may, or may not, also accomplish the inversion (turning over) of the sheet. In some applications, for example, where the "inverter" is located at the corner of a 90° to 180° inherent bend in the copy sheet path, the inverter may be used to actually prevent inverting of a sheet at that point, i.e., to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain, or change, the sheet orientation.

Without the invention, the sheet can move on the trail edge due to the fast speed of air movement. The sheet trail edge can fly towards the wrong position if paper movement is too fast. This could cause a jam into deflector 300.

Further features and advantages of the invention pertain to the particular apparatus and steps whereby the above noted aspects of the invention are attained. Accordingly, the invention will be better understood by reference to the following description, and to the drawings forming a part thereof, which are approximately to scale, wherein.

Figure 1:
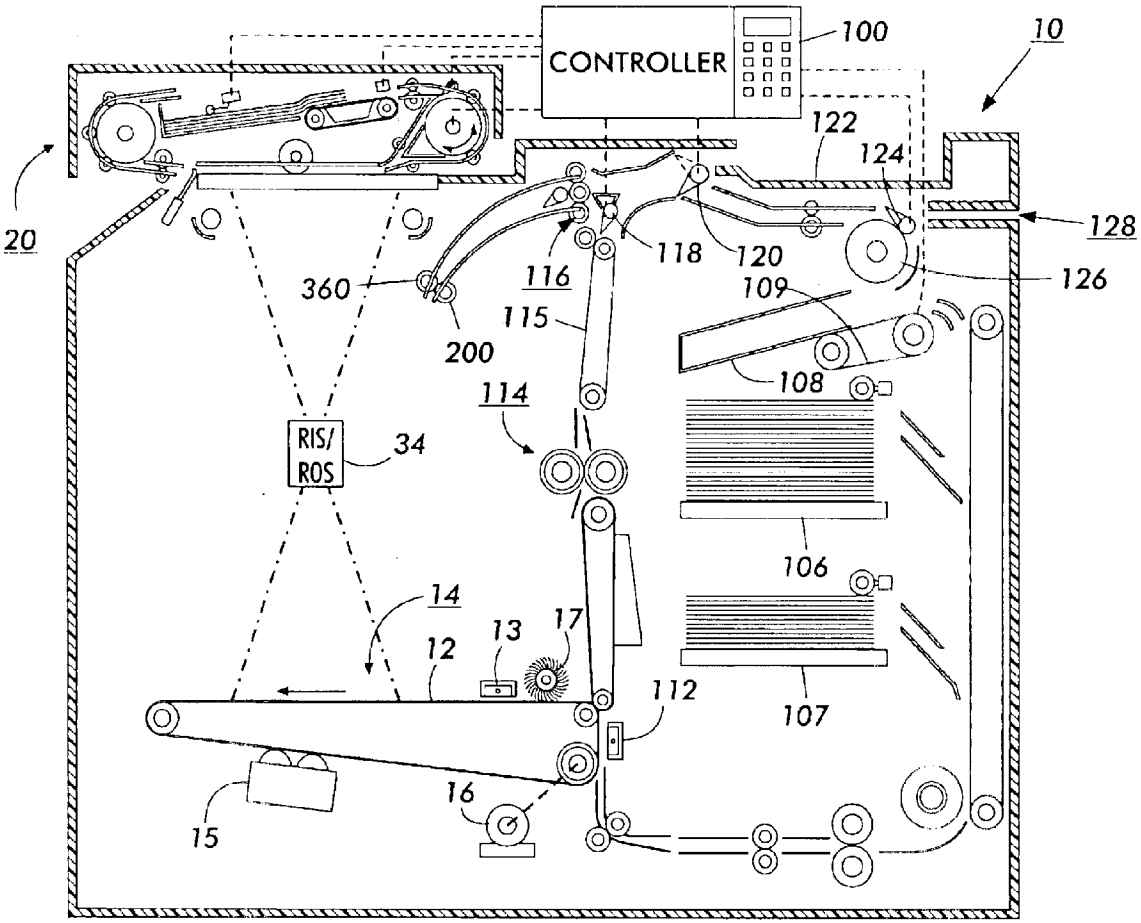
FIG. 1 is a schematic side view of an exemplary copier incorporating an aspect of the present invention.

Referring to the exemplary xerographic copier 10 shown in FIG. 1, and its exemplary automatic document feeding unit 20, it will be appreciated that various other re-circulating document feeding units and copiers/printers may be utilized with the present invention.

The exemplary copier 10 conventionally includes a xerographic photoreceptor belt 12 and the xerographic stations acting thereon for respectively charging 13, exposing 14, developing 15, driving 16 and cleaning 17. The copier 10 is adapted to provide duplex or simplex pre-collated copy sets from either duplex or simplex original documents copied from the recirculating document handler 20. Two separate copy sheet trays 106 and 107 are provided to feed clean copy sheets from either one. The control of the sheet feeding is, conventionally, by the machine controller 100. The controller 100 is preferably a known programmable microprocessor as exemplified by U.S. Pat. No. 4,144,550, issued to J. Donahue et al. on Mar. 13, 1979 which conventionally also controls all of the other machine functions described herein including the operation of the document feeder, the document and copy sheet gates, the feeder drives, etc., and is incorporated herein by reference. As further disclosed, it also conventionally provides for storage and comparison of the counts of the copy sheets, the number of documents recirculated in a document set, the number of copy sheets selected by the operator through the switches thereon, etc.

The copy sheets are fed from a selected one of the trays 106 or 107 to the xerographic transfer station 112 for the transfer of the xerographic image of a document page to one side thereof. The copy sheets here are then fed through vacuum transports vertically up through a conventional roll fuser 114 for the fusing of the toner image thereon. From the fuser, the copy sheets are fed to a gate 118 which functions as an inverter selector finger. Depending on the position of the gate 118, the copy sheets will either be deflected into a sheet inverter 116 or bypass the inverter and be fed directly onto a second decision gate 120. Those copy sheets which bypass the inverter 116 (the normal path here) have a 90° path deflection before reaching the gate 120 which diverts the copy sheets into a face-up orientation, i.e., the image side which has just been transferred and fused is face-up at this point. The second decision gate 120 then either deflects the sheets without inversion directly into an output tray 122 or deflects the sheets into a transport path which carries them on without inversion to a third decision gate 124. This third gate 124 either passes the sheets directly on without inversion into the output path 128 of the copier, or deflects the sheets into a duplex inverting roller transport 126. The inverting transport 126 feeds the copy sheets into a duplex tray 108. The duplex tray 108 provides intermediate or buffer storage for those copy sheets which have been printed on one side and, if it is desired, to subsequently print an image on the opposite side thereof, i.e., the sheets being duplexed. Due to the sheet inverting by the roller 126, these buffer set copy sheets are stacked into the duplex tray face-down. They are stacked in the duplex tray 108 on top of one another in the order in which they were copied.

For the completion of duplex copying, the previously simplexed copy sheets in the tray 108 are fed seriatim by the bottom feeder 109 from the duplex tray back to the transfer station for the imaging of their second or opposite side page image. This duplex copy sheet path is basically the same copy sheet path provided for the clean sheets from the trays 106 or 107, illustrated at the right hand and bottom of FIG. 1. It may be seen that this sheet feed path between the duplex feeder 109 and the transfer station 112 inverts the copy sheets once. However, due to the inverting roller 126 having previously stacked these sheets face-down in the tray 108, they are presented to the transfer station 112 in the proper orientation, i.e., with their blank or opposite sides facing the photoreceptor 12 to receive the second side image. The now duplexed copy sheets are then fed out through the same output path through the fuser 114 past the inverter 116 to be stacked with the second printed side faceup. These completed duplex copy sheets may then be stacked in the output tray 122 or fed out past the gate 124 into the output path 128.

The output path 128 transports the finished copy sheets (simplex or duplex) either to another output tray, or, preferably, to a finishing station where the completed pre-collated copy sheets may be separated and finished by on-line stapling, stitching, gluing, binding, and/or off-set stacking.

Figure 2:
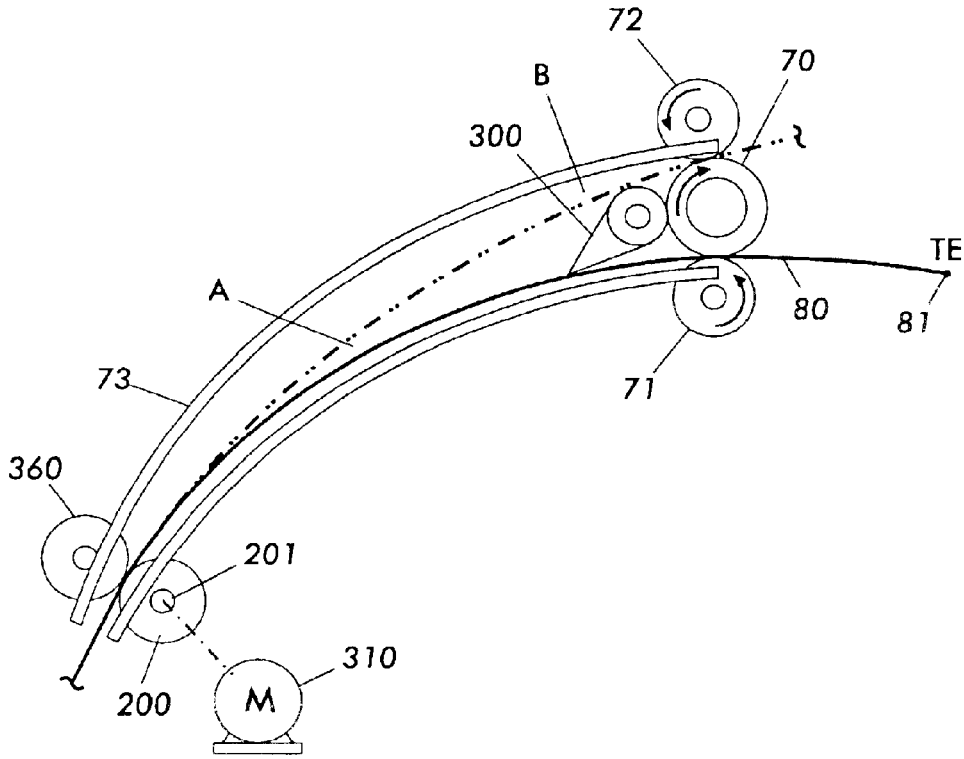
FIG. 2 is an exploded side view of the inverter shown in FIG. 1.
Figure 3:
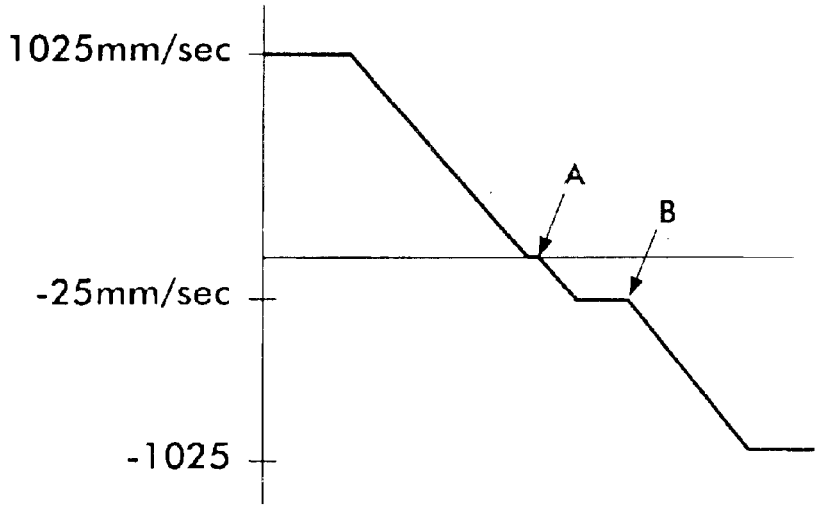
FIGS. 3–4 are graphs illustrating speed of the drive rolls.
Figure 4:
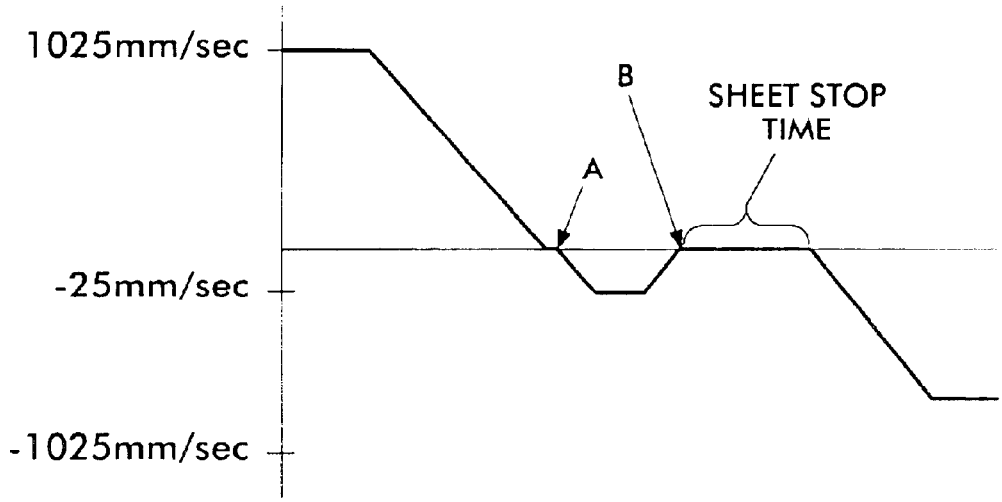

In reference to an aspect of the present invention and FIGS. 2–4, when inversion of copy sheets is required, for example, job recovery, maintaining face-up or face-down output collation, simplex/duplex copying with an odd number of simplex documents, etc., tri-roll inverter 116 is used. Copy sheets are fed from either tray 106 or 107 past transfer means 112 and onto conveyor 115. As a sheet leaves conveyor 115, it approaches decision gate 118 which is controlled by controller 100. Gate 118 is actuated to the right as viewed in FIG. 1 which causes sheet 80 to be deflected into an input nip formed by rollers 70 and 71. These rollers drive the sheet into chute 73 and subsequently into a second roll on roll nip formed between idler roll 360 and drive roller 200 which is driven by conventional means motor 310.

Drive roller 200 mounted on shaft 201 can be rotated in a clockwise direction or counter clockwise direction. Controller 100 controls the speed and direction of drive roller 200. When the last portion (trailing edge 81) of the sheet 80 leaves the nip between rollers 70 and 71 to position "A", diverter 300 moved to allow the sheet a path of movement out of the inverter. Next, the sheet can be fed out of the inverter allowing sheet inversion. The sheet is fed at a slow or vary increasing speed until the trailing edge 81 reaches position "B" adjacent to diverter 300. Once the trailing edge 81 reaches position "B", drive roll 200 substantially increases the speed to a second velocity, or stops the sheet for a period of time, so that the sheet is ready to enter nip 70, 72. The slow speed from position A to B allows the sheet trailing edge to not fly towards the entrance path or diverter 300. Also, if the stop time is a long time, the sheet is in position B. In position B the sheet curl properties can change and will not affect the sheet entering nip 70, 72.

After moving through nip 70, 72, the sheet approaches gate 120 which is actuated by controller 100 into either the dotted line or solid line positions shown in FIG. 1 depending on the reason for inverting.

While the inverter system disclosed herein is preferred, it will be appreciated that various alternatives, modifications, variations or improvements thereon may be made by those skilled in the art, and the following claims are intended to encompass all of those falling within the true spirit and scope of this invention.

What is claimed is:

1. A substrate inverter, comprising:

an inversion channel having an input path having an input nip and output path having an output nip;

input drive means for driving a substrate into said inversion channel means in an initial incoming direction so that a leading edge and trailing edge of said substrate pass by said input nip until said trailing edge of substrate reaches a first position in said inversion channel;

output drive means for driving said substrate out of said inversion channel in an output direction generally opposite said initial incoming direction; said output drive means includes a nip for engaging said leading edge of said substrate when said substrate is in said first position;

a controller for adjusting speed of said output drive means so that substrate is driven a first speed until said trailing edge of substrate reaches a second position in said inversion channel, and second speed when said trailing edge passes said second position or stops.

2. A substrate inverter of claim 1 further comprising a gate associated with said inversion channel.

3. A printing system having a substrate inverter, comprising:

an inversion channel having an input path having an input nip and output path having an output nip;

input drive means for driving a substrate into said inversion channel means in an initial incoming direction so that a leading edge and trailing edge of said substrate pass by said input nip until said trailing edge of substrate reaches a first position in said inversion channel;

output drive means for driving said substrate out of said inversion channel in an output direction generally opposite said initial incoming direction; said output drive means includes a nip for engaging said leading edge of said substrate when said substrate is in said first position;

a controller for adjusting speed of said output drive means so that substrate is driven a first speed until said trailing edge of substrate reaches a second position in said inversion channel, and second speed when said trailing edge passes said second position or stops.

* * * * *